US008020235B2

(12) United States Patent
Grace

(10) Patent No.: US 8,020,235 B2
(45) Date of Patent: Sep. 20, 2011

(54) CONCRETE BRIDGE

(75) Inventor: Nabil F. Grace, Rochester Hills, MI (US)

(73) Assignee: Lawrence Technological University, Southfield, MI (US)

( * ) Notice: Subject to any disclaimer, the term of this patent is extended or adjusted under 35 U.S.C. 154(b) by 190 days.

(21) Appl. No.: 12/211,160

(22) Filed: Sep. 16, 2008

(65) Prior Publication Data

US 2010/0064454 A1 Mar. 18, 2010

(51) Int. Cl.
*E01D 19/02* (2006.01)

(52) U.S. Cl. ..... 14/74.5; 14/73; 14/77.1; 14/78; 52/223.7

(58) Field of Classification Search ..... None
See application file for complete search history.

(56) References Cited

U.S. PATENT DOCUMENTS

| | | | | |
|---|---|---|---|---|
| 2,101,538 | A | 12/1937 | Faber | |
| 3,398,498 | A | 8/1968 | Krauss | |
| 3,906,687 | A | 9/1975 | Schupack | |
| 3,909,863 | A * | 10/1975 | Macrander et al. | 14/74.5 |
| 4,366,655 | A | 1/1983 | Mayer et al. | |
| 4,453,283 | A | 6/1984 | Fitzgerald-Smith et al. | |
| 4,620,400 | A | 11/1986 | Richard | |
| 4,704,754 | A * | 11/1987 | Bonasso | 14/20 |
| 4,710,994 | A * | 12/1987 | Kishida et al. | 14/77.1 |
| 5,437,072 | A | 8/1995 | Dinis et al. | |
| 5,457,839 | A | 10/1995 | Csagoly | |
| 5,784,739 | A * | 7/1998 | Kawada et al. | 14/18 |
| 5,896,609 | A * | 4/1999 | Lin | 14/20 |
| 6,065,257 | A | 5/2000 | Nacey et al. | |
| 6,138,309 | A | 10/2000 | Tadros et al. | |
| 6,145,270 | A | 11/2000 | Hillman | |
| 6,176,051 | B1 | 1/2001 | Sorkin | |
| 6,345,403 | B1 * | 2/2002 | Nagle | 14/77.1 |
| 6,751,821 | B1 | 6/2004 | Han | |
| 6,790,518 | B2 | 9/2004 | Grace et al. | |
| 6,832,454 | B1 | 12/2004 | Iyer | |
| 6,857,156 | B1 | 2/2005 | Grossman | |
| 7,296,317 | B2 | 11/2007 | Grace | |
| 7,373,683 | B2 * | 5/2008 | Moon | 14/74.5 |
| 7,475,446 | B1 * | 1/2009 | He | 14/77.1 |
| 2004/0216249 | A1 | 11/2004 | El-Badry | |
| 2005/0097686 | A1 * | 5/2005 | Royer | 14/18 |

OTHER PUBLICATIONS

New York State Department of Transportation (NYSDOT) Bridge Design Sheets BD-PA3 to BD-PA5 (Prestressed Concrete Box Beams) issued Jan. 26, 2005 by the NYSDOT Chief Engineer (Structures) to provide guidelines for NYSDOT standards of bridge design.

Saito, M., "Carbon Fiber Composites in the Japanese Civil Engineering Market—Conventional Uses and Developing Products," SAMPE Journal, vol. 38, No. 5, Sep./Oct. 2002, pp. 20-25.

Nippon Steel Composite Co., Ltd. Brochure—FRP Grid FORCA TOWGRID (4 pages).

Nefcom Corporation Brochure—FRP Reinforcing Bar NEFMAC (4 pages).

Grace, Nabil F., et al., Design-Construction of Bridge Street Bridge—First CFRP Bridge in the United States; PCI Journal; Sep.-Oct. 2002; pp. 20-35.

Grace, Nabil F., et al., Development and Application of Innovative Triaxially Braided Ductile FRP Fabric for Strengthening Concrete Beams; Science Direct; Composite Structures 64; Sep. 2003; pp. 521-530; Elsevier Ltd.

(Continued)

*Primary Examiner* — Raymond Addie
(74) *Attorney, Agent, or Firm* — Dickinson Wright PLLC

(57) ABSTRACT

An improved prestressed concrete bridge having internal and external tensioning tendons which follow approximately similar pathways which are not straight.

23 Claims, 7 Drawing Sheets

OTHER PUBLICATIONS

Grace, Nabil F., et al., Behavior of CFCC and CFRP Leadline Prestressing Systems in Bridge Construction; PCI Journal; May-Jun. 2002; pp. 90-103.
Special Award Winners; Harry H. Edwards Industry Advancement Award, Co-Winner; Ascent; Fall 2002; pp. 6-8 and 10.
First CFRP Bridge in the USA Michigan Researchers and Consultants Using Tomorrow's Technology Today; C&T Research Record; Feb. 2003; pp. 1-4; Issue No. 97; Michigan Department of Transportation's Construction and Technology Division.
Grace, Nabil F. et al.; Full-Scale Test of Prestressed Double-Tee Beam; Concrete International; Apr. 2003; pp. 52-58.
Grace, Nabil F.; Strengthening of Negative Moment Region of Reinforced Concrete Beams Using Carbon Fiber-Reinforced Polymer Strips; ACI Structural Journal; May-Jun. 2001; pp. 347-358; Title No. 98-S33.
Grace, Nabil F.; Improved Anchoring System for CFRP Strips; Concrete International; Oct. 2001; pp. 55-60.
Grace, Nabil F. et al.; Durability Evaluation of Carbon Fiber-Reinforced Polymer Strengthened Concrete Beams: Experimental Study and Design; ACI Structural Journal; Jan.-Feb. 2005; pp. 40-53; Title No. 102-S05.
Grace, Nabil F. et al.; Strengthening of Concrete Beams Using Innovative Ductile Fiber-Reinforced Polymer Fabric; ACI Structural Journal; Sep.-Oct. 2002; pp. 692-700; Title No. 99-S71.
Grace, Nabil F. et al.; Concrete Foundation for a Truck and Bus Road Test Stimulator; Concrete International; Jan. 1995; pp. 35-41.
Svaty, Jr., Karl J. et al.; City of Wichita Implements Pioneering Rehab Technologies; 5 pgs.
McCraven, Sue, Taking Precast Concrete to the Limit; Precast, Inc. Magazine; Jan.-Feb. 2009; pgs. cover and 16-19; NCPA.
Grace, Nabil F., et al., Transverse Diaphragms and Unbonded CFRP Post-Tensioning in Box-Beam Bridges; PCI Journal; Spring 2010; pp. 1-14.
Grace, Nabil F., Response of Continuous CFRP Prestressed Concrete Bridges Under Static and Repeated Loadings; PCI Journal; Nov.-Dec. 2000; pp. 84-102.
Grace, Nabil F. et al.; Strengthening Reinforced Concrete Beams Using Fiber Reinforced Polymer (FRP) Laminates; ACI Structural Journal; Sep.-Oct. 1999; pp. 865-875; Title No. 96-S95.
Grace, Nabil F.; Continuous CFRP Prestressed Concrete Bridges; Concrete International; Oct. 1999; pp. 42-47.
Prototype CFRP/CFCC Precast Prestressed Girder Successfully Tested; PCI Journal; Nov.-Dec. 2000; pp. 119-130.
Grace, Nabil F., et al., Flexural Behavior of Precast Concrete Box Beams Post-Tensioned With Unbonded, Carbon-Fiber-Composite Fibers; PCI Journal; Jul.-Aug. 2008; pp. 62-82.
Grace, Nabil F. et al.; Double Tee and CFRP/GFRP Bridge System; Concrete International; Feb. 1996; pp. 39-44.
Grace, Nabil F., et al., Behavior and Ductility of Simple and Continuous FRP Reinforced Beams; Journal of Composites For Construction; Nov. 1998; pp. 186-194.
Grace, Nabil F., Fiber Reinforced Polymers; Precast Solutions; Sep.-Oct. 2008; pgs. cover 8-14.
Grace, Nabil F., Materials For The Future: Innovative Uses For FRP Materials For Construction; Technology Century; Summer 2002; pp. 26-29.
Grace, Nabil F., New Ideas Shape The Industry: Innovative Uses For FRP Materials For Construction; Technology Century; May-Jun. 2002; pp. 26-29.
Grace, Nabil F. et al.; Resonance/Vibration Problem of Deep Foundation; Concrete International; Jan. 1997; pp. 26-32.
Grace, Nabil F., et al., Truck Load Distribution Behavior of the Bridge Street Bridge, Southfield, Michigan; PCI Journal; Mar.-Apr. 2005; pp. 2-15.
Grace, Nabil F., et al., Behavior of Externally Draped CFRP Tendons in Prestressed Concrete Bridges; PCI Journal; Sep.-Oct. 1998; pp. 88-101.
Grace, Nabil F. et al.; Design Approach for Carbon Fiber-Reinforced Polymer Prestressed Concrete Bridge Beams; ACI Structural Journal; May-Jun. 2003; pp. 365-376; Title No. 100-S40.
Grace, Nabil F., et al., Experimental Study and Analysis of a Full-Scale CFRP/CFCC Double-Tee Bridge Beam; PCI Journal; Jul.-Aug. 2003; pp. 120-139.
Grace, Nabil F., et al., Flexural Response of CFRP Prestressed Concrete Box Beams for Highway Bridges; PCI Journal; Jan.-Feb. 2004; pp. 92-104.
Grace, Nabil F.; Concrete Repair With CFRP; Concrete International; May 2004; pp. 45-52.
Grace, Nabil F. et al.; Load Testing A CFRP-Reinforced Bridge; Concrete International; Jul. 2004; pp. 1-7.
Grace, Nabil F. et al.; Ductile FRP Strengthening Systems; Concrete International; Jan. 2005; pp. 31-36.
Grace, Nabil F. et al.; Concrete Beams Reinforced With CFRP; Concrete International; Feb. 2005; pp. 1-5.
Rohleder, Jr., W. Jay et al.; CFRP Strand Application on Penobscot Narrows Cable Stayed Bridge; pp. 1-15.

* cited by examiner

CONCRETE BRIDGE

BACKGROUND OF THE INVENTION

The present invention is generally directed to a bridge and more particularly, to an improved pre-stressed, concrete bridge having both internal and external tensioning tendons.

Engineers are consistently striving to build bridges that are stronger, lighter, and capable of spanning longer distances while having improved durability and lower costs. Increasing the distance that a bridge may span without supporting piers or increasing the distance between supporting piers is also very desirable. To accomplish the above goals, engineers over the years have moved from stone and wood bridges to iron and steel bridges, to reinforced concrete bridges and more recently to pre-stressed concrete bridges.

Reinforced concrete bridges are generally poured in place around a rebar or other reinforcing members. As concrete, under its own dead weight may generate huge compressive forces, some reinforced concrete bridges experience downward creep which could lead to eventual failure of the bridge. To prevent downward creep, the length of distance span by reinforced concrete bridges is limited. To solve these problems, engineers developed pre-stressed concrete bridges and over the years technology for pre-stressed concrete bridges has developed to three main methods for pre-stressing the concrete.

The first method is to cast the concrete around an already pre-stressed tendon or tendons. This method works well for pre-cast concrete members that are then shipped to the site of the bridge and lifted individually into place. Although more difficult to implement due to the difficulty in locating the anchors to provide tension, this method may also be used by bridges that are cast in place on site. The method of casting concrete around already prestressed or pretensioned tendons provides an excellent bond between the tendon and the concrete. This bond increases the resistance to corrosion of metal tendons and allows as the concrete adheres and bonds to the tendons direct transfer of tension from the tendon to the concrete. If the tension on the tendon is released, the tension is transferred to the concrete by static friction minimizing any problems with release of tension on the tendon. This method also allows precasting of pieces without anchors that maintain tension during shipment and lifting into position. Precasting pretensioned pieces allows higher levels of quality control due to the ability to control the curing process as discussed below. Therefore, the bridge elements are usually pre-cast or pre-fabricated off site and then transported to the bridge site. Transportation difficulties may limit the size of the pre-cast portions thereby limiting the distance that the concrete bridge may span without supporting piers. Another problem with the above method is that the tendons usually limited to a pathway in the concretes of a straight line, due to the tension being pre-applied before the concrete is cast around the tendons. Applying tension to the tendons before casting of the concrete limits the pathways that the tendon may follow and thereby limits the availability of additional strength through various other pathways. Attempts to modify the pathway from a straight line typically cause other problems, which usually detract from the structural capabilities of the cast concrete member.

The second method is to cast a pathway into the concrete for the tendon to be later passed through. This method is typically known as bond post-tension concrete. More specifically, the concrete is cast around a hollow member that creates a tendon passageway. The hollow member may be formed from a variety of materials such as plastic, steel or aluminum.

While the hollow members are typically formed in a straight line, in some instances they may be curved or have other shapes or pathways. While the concrete is typically cast without the tendon inserted into the hollow member, in some instances the casting occurs with the tendon inserted into the passageway member which may provide for easy manufacturing as the tendon may be difficult to insert in certain non-straight pathway configurations. After the concrete is cast, tension may be applied to the tendons. The concrete may be cast in place at the site of the bridge or pre-cast and lifted in sections into place. This method is commonly used in pre-tensioned concrete bridges.

The third method is called unbonded post-tension concrete. In unbonded post-tension concrete, the concrete is cast around the tendons which are not tensioned which also allows for the tendons to be able to form non-straight pathways. In place of a passageway member, the tendons are generally coated with a low friction material such as lithium grease and sheaved generally plastic sheeting formed by an extrusion process. As with bonded post-tensioned concrete bridges, anchors and other devises to secure tension are required. Some bridges use a combination of the above methods.

Some bridges in place of internal tensioned tendons in the concrete have used external tensioned tendons. Traditionally external tendons were not desirable as they were subject to corrosion and required regular maintenance, such as painting of steel cables to maintain integrity of the cables. External tendons typically ran under transverse beams and then upward on each end to anchor the tendons. The problem with using external tendons beyond the lack of durability for steel tendons was that the available pathways are limited and the external tendons are very weak in the transverse or lateral direction compared to the internal tendon.

While the above methods provide improvement in bridges and allow for greater spans to be made without supporting piers, it is desirable to further improve upon post-tension concrete and the above methods to create a cost-effective bridge that is easy to assembly while improving the durability, lowering the maintenance costs, and allowing the greater spans of distances in a cost-effective manner.

SUMMARY OF THE INVENTION

The present invention is directed to a concrete bridge with tensioned tendons and more particularly to a concrete bridge having internal and external tendons where one of each of the internal and external tendons follow similar pathways.

The bridge generally includes longitudinal load members each including an internal longitudinally extending tendon extending along a pre-determined path. The longitudinal load members typically extend across one span of the bridge and for multiple span bridges are supported by piers near the ends of longitudinally adjoining longitudinal load members. A continuously extending external tendon extends along the path which is similar to the pathway of the internal continuously extending tendon. The first and second paths may be parallel or at least approximately similar. Each longitudinal load member may include additional tendons, such as some having pathways similar to the external tendon and some having pathways different to the external tendon. For example, some internal tendons may follow the pathway of the external tendon while other internal tendons follow a straight path.

The bridge includes a transverse tendon extending approximately perpendicular to the internal and external tendons. The transverse tendons extend through transverse beams to provide transverse or lateral stability to the bridge.

The transverse beams may act as anchors for the external tendons, such as the external tendons extending through at least two transverse beams and around additional transverse beams. The transverse beams acting as anchors and through which the external extends are located generally near the end of the longitudinal load members while the transverse members around which the external tendon extend are located between the anchoring transverse members.

Further scope and applicability of the present invention will become apparent from the following detailed description, claims and drawings. However, it should be understood that the specific examples in the detailed description are given by way of illustration only, since various changes and modifications within the spirit and scope of the invention will become apparent to those skilled in the art.

BRIEF DESCRIPTION OF THE DRAWINGS

The present invention will become more fully understood from the detailed description given here below, the appended claims, and the accompanying drawings in which:

DETAILED DESCRIPTION OF THE PREFERRED EMBODIMENT

Figure 1:
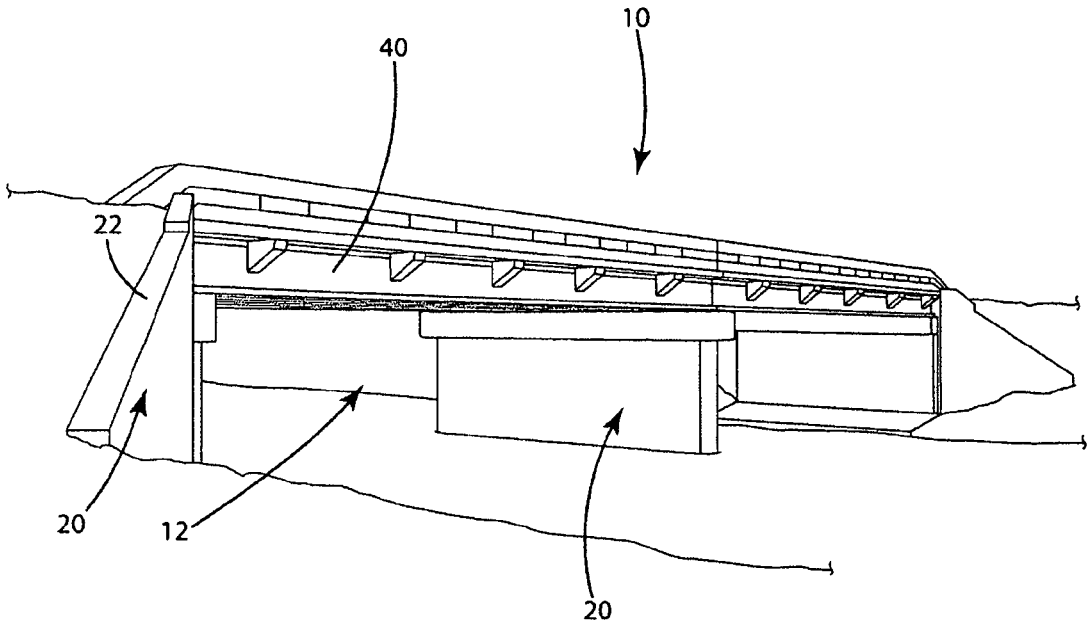
FIG. 1 is a perspective view of a bridge.
Figure 2:
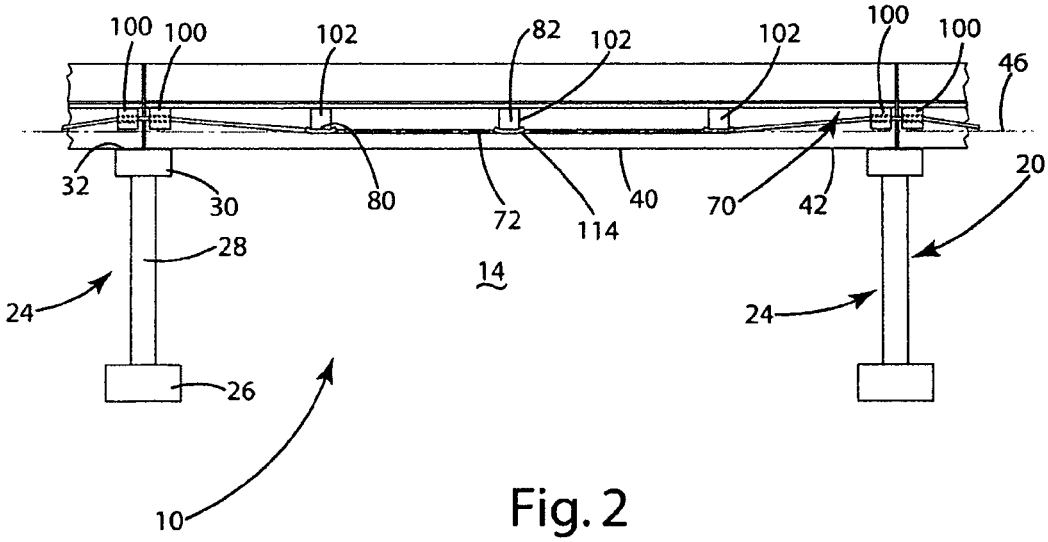
FIG. 2 is a partial sectional side view of a bridge.

The present invention is directed to a bridge 10, generally illustrated in FIGS. 1 and 2. The bridge 10 is supported by a support structure 20 which supports longitudinal load members 40 which in turn supports the deck 132 or traffic surface of the bridge 10. The bridge 10 is generally formed from concrete and pre-stressed through the use of external and internal tendons or tensioning members 68 and 72. As used in this application, the term pre-stressed or pre-tensioned refers to a bridge that uses tension created by tendons to increase strength, irrelevant whether the tension was applied to the tendons before or after the concrete was poured and irrelevant whether the bridge was poured in place or formed from numerous pre-cast pieces. As described in the Background of the Invention, the use of tensioning tendons allows the spanning or greater distances without support and greater load capabilities for the bridge 10.

As with all bridges, the bridge 10 of the present invention is supported by a support structure 20. While any support structure may be used, which vary widely in size shape and style, most bridges include an abutment 22 at each end for support. For concrete bridges having multiple spans, piers 24 are generally used. Most piers 24 generally include a pier foundation 26, at least one support column 28 extending upwardly from the pier foundation 26, and a pier head 30 supported by the support columns 28. The pier head 30 includes an upper support surface 32 which is configured to support two adjoining spans 12 near their ends.

A longitudinal load member 40 is supported by the support structure 20. Each set of laterally adjacent longitudinal load members 40 forms a single span 12. Therefore, for a single span bridge, only one set of adjacent longitudinal load members 40 is needed, and for multiple span bridges, the support structure 20 supports two longitudinally adjacent spans or more specifically two longitudinally adjacent longitudinal load members 40 with the piers 22. The longitudinally adjacent longitudinal load members 40 are typically aligned and meet over the piers 22. As pre-stressed concrete bridges 10 may vary widely in size, shape and style, some pre-stressed concrete bridges such as for small pedestrian bridges or other narrow bridges, only one longitudinal load member 40 may be required. However, most bridges having a width for at least two-way vehicular traffic, will have a plurality of laterally adjacent longitudinal load members 40. Of course, the longitudinal load members 40 may be formed large enough to only require a single longitudinal load member to support multiple or singular vehicle lanes.

Figure 3:
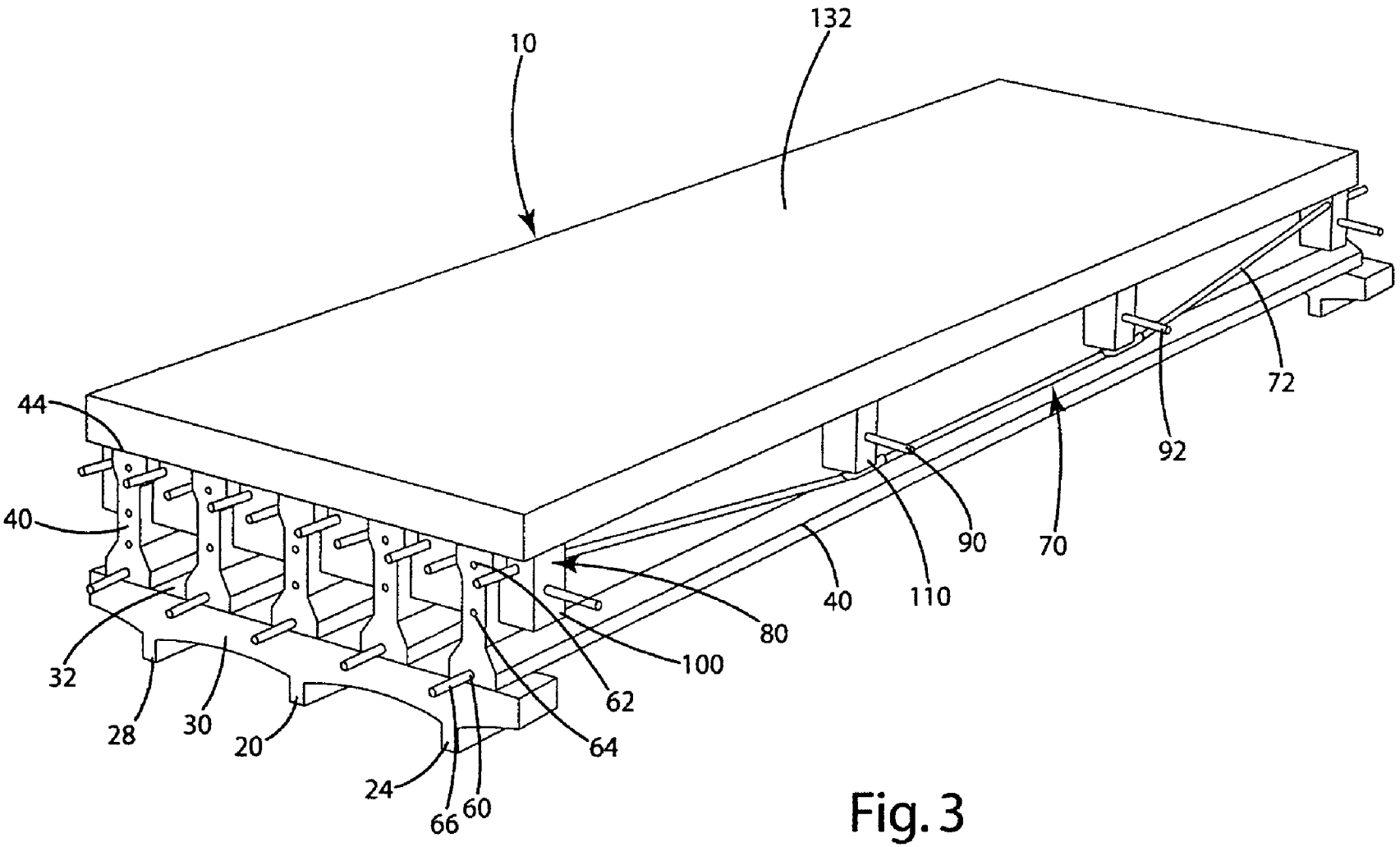
FIG. 3 is a top perspective view of a partial exemplary I-beam longitudinal load member bridge incorporating the present invention.
Figure 4:
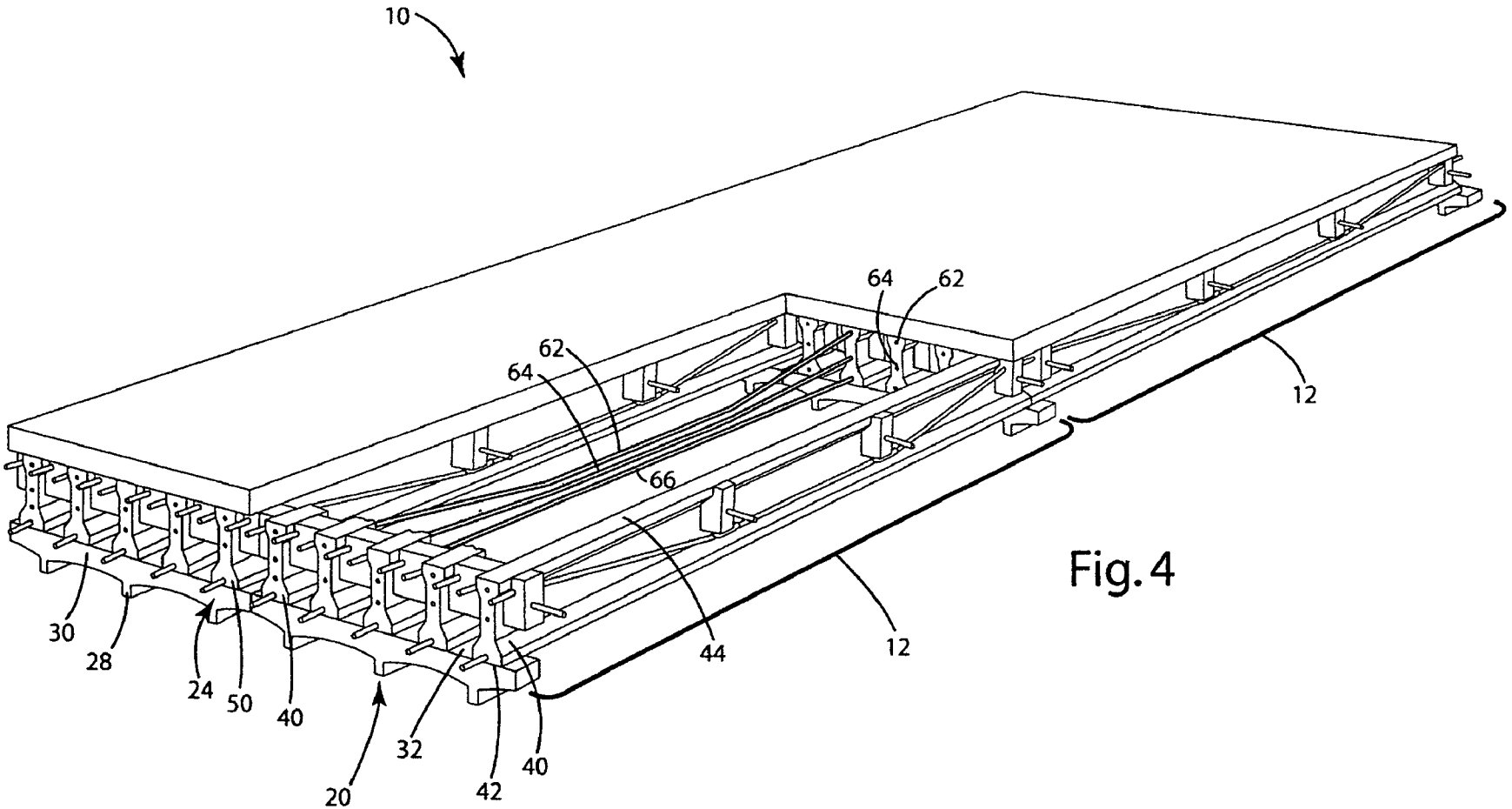
FIG. 4 is a second top perspective view of an exemplary I-beam bridge illustrated with portions of the concrete removed to show exemplary routing pathways of the various internal and external tendons.
Figure 5:
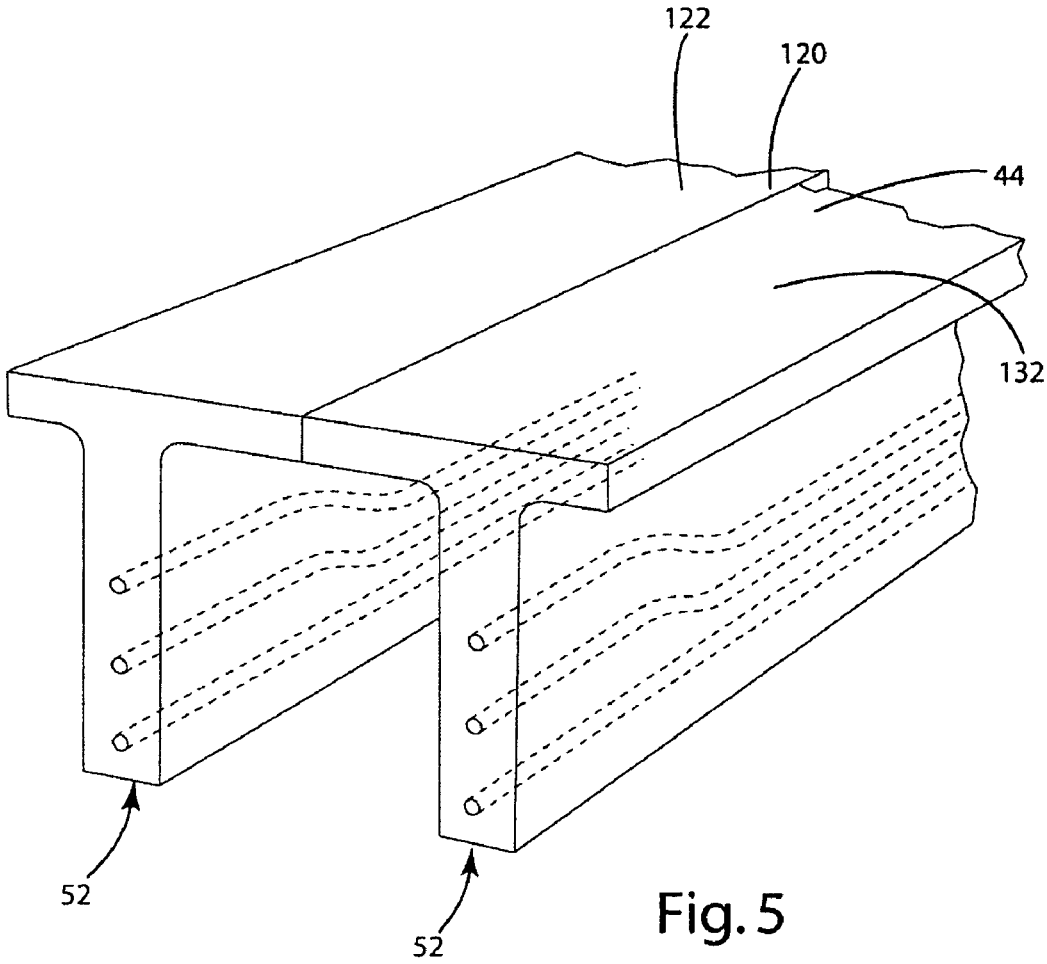
FIG. 5 is a partial perspective sectional view of a T-beam longitudinal load member.
Figure 6:
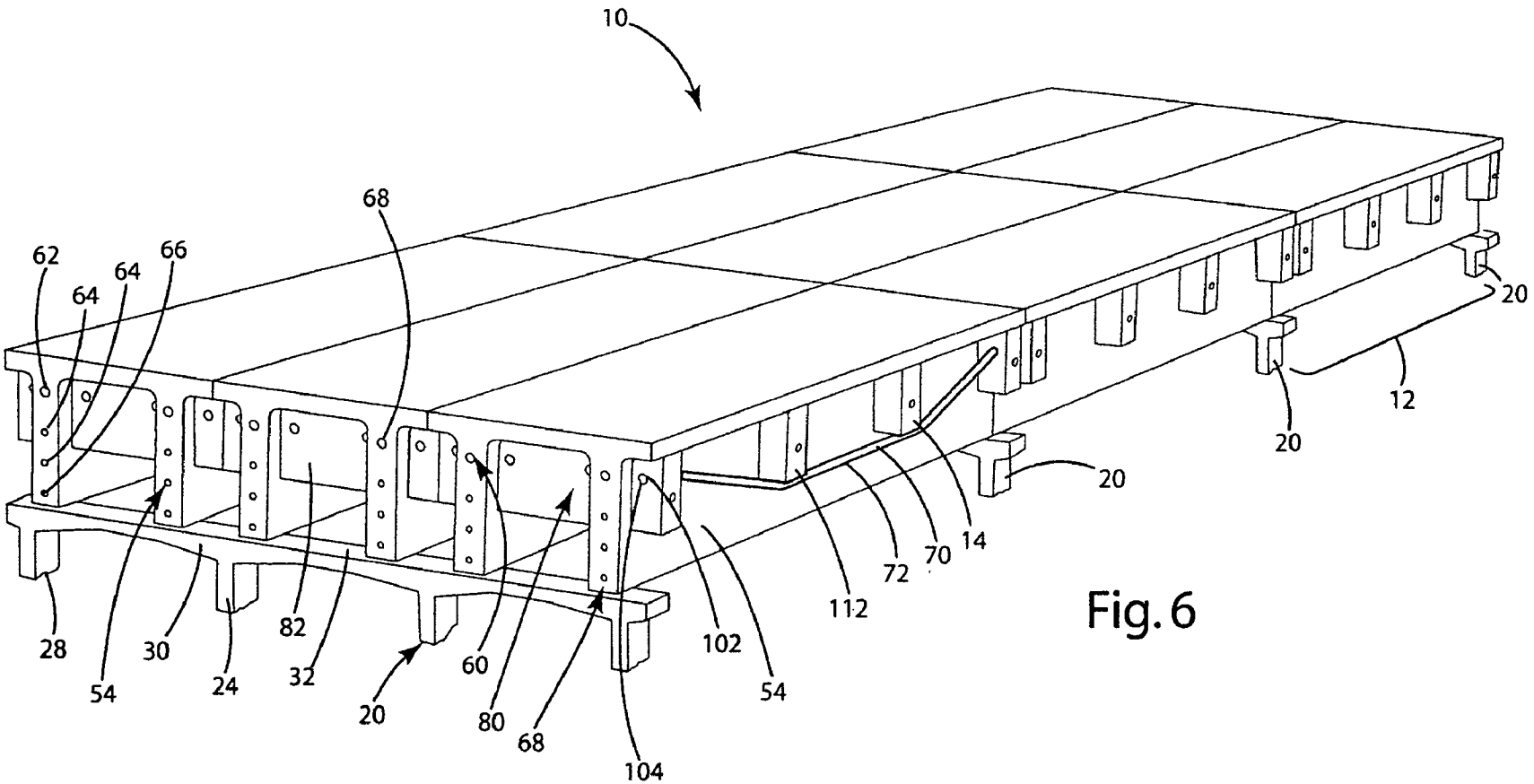
FIG. 6 is a partial top perspective view of a bridge with a double T-beam longitudinal load member.
Figure 7:
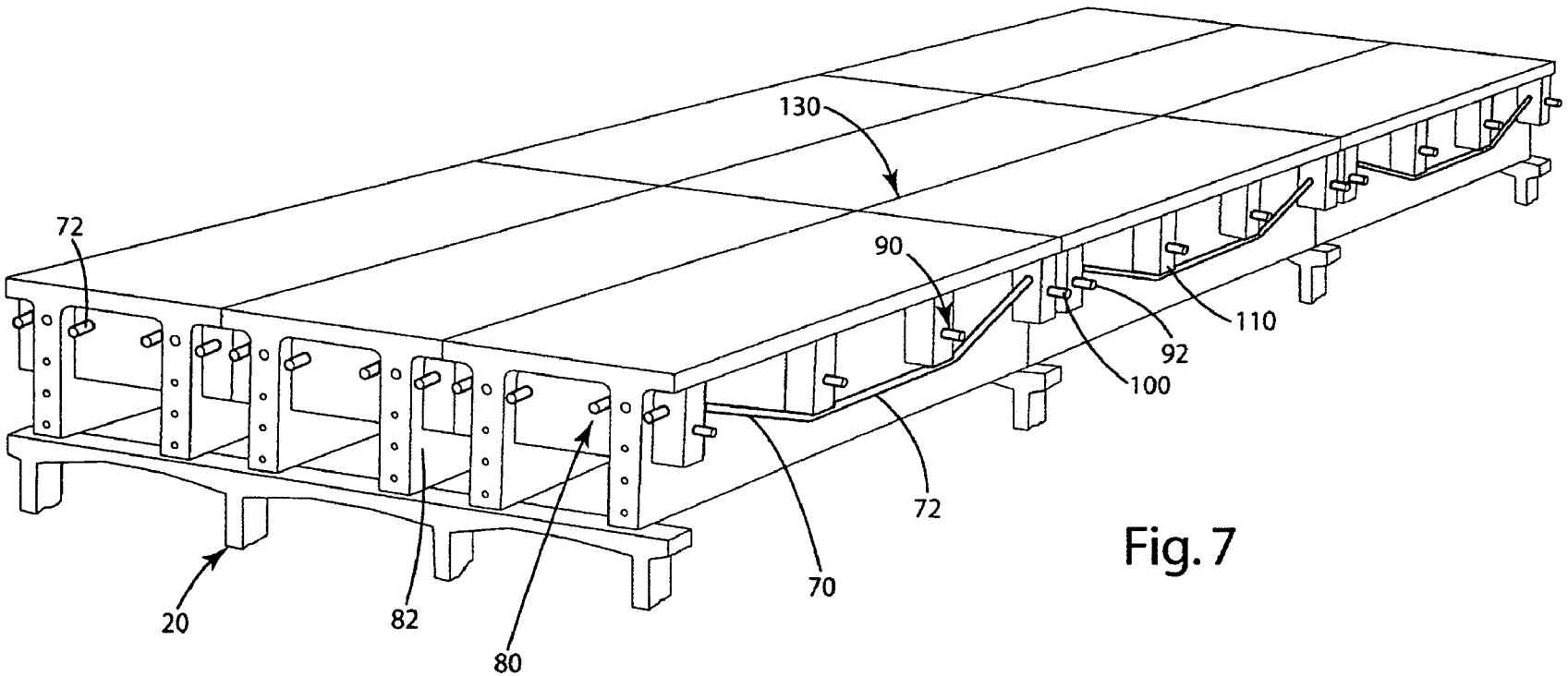
FIG. 7 is a top perspective view of a bridge with an FRP reinforcement layer.
Figure 8:
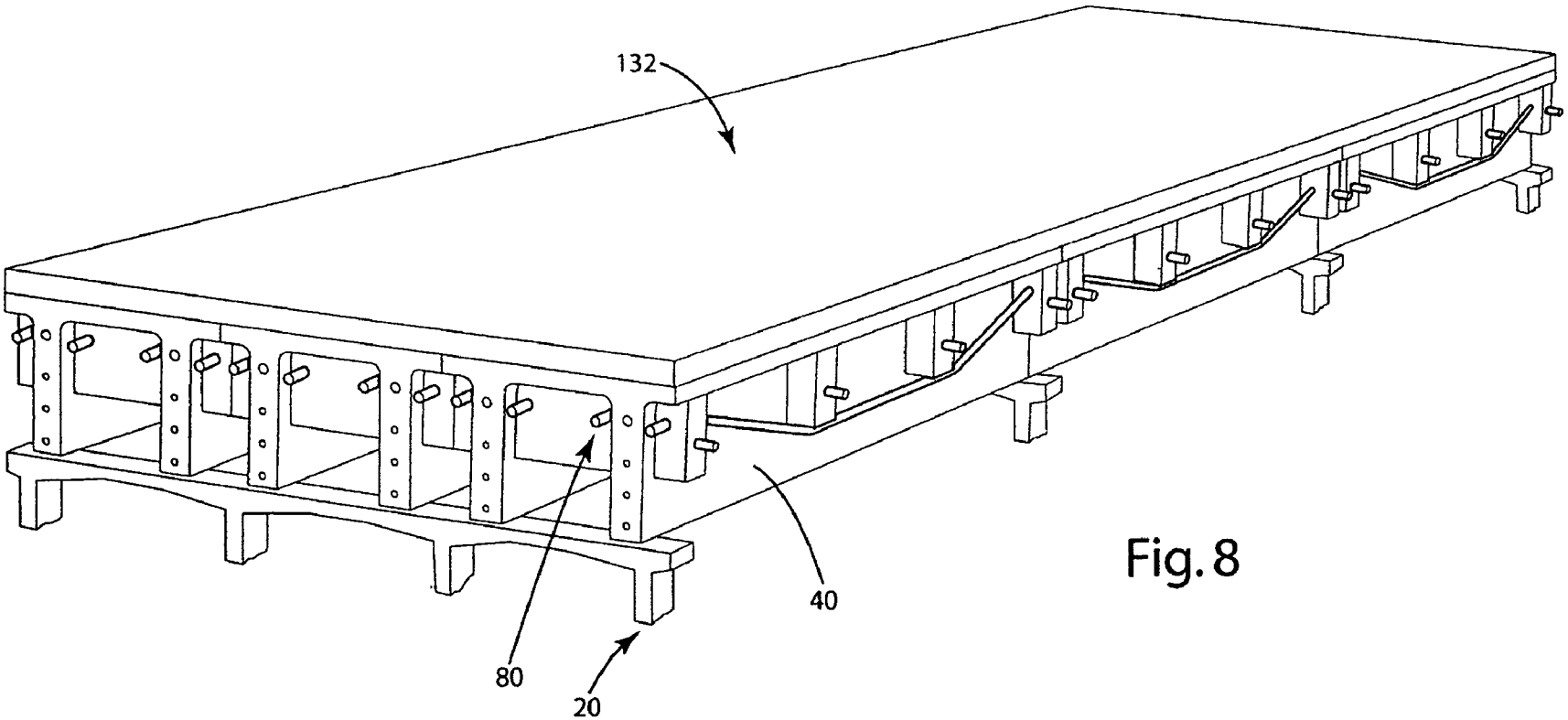
FIG. 8 is a top perspective view of a bridge with a deck slab in place.

The longitudinal load member 40 can have any desired size, shape or configuration. As illustrated in FIGS. 3 and 4, the longitudinal load member 40 may be formed in the shape of an I-beam or similar shape. Other exemplary shapes are illustrated in FIG. 5 such as a T-beam 52 and in FIG. 6 a double T-beam 54. Of course, a variety of other longitudinal load member shapes and styles may be used. The longitudinal load member 40 may be pre-cast or poured on site at location of the desired bridge. Both pre-cast and on-site pouring each have their advantages and disadvantages. Lately, more and more pre-stressed concrete bridges are being pre-cast in sections and then shipped to the site of the bridge as increased quality control may be easily accomplished as well as control of the environmental conditions during the curing of the concrete. In comparison, changes in the environmental conditions at the site of the bridge for concrete cast on-site and limited ability to control the curing process may affect the strength and durability of the bridge and in a particular, the strength and durability of the longitudinal load members. For example, in forming a pre-cast longitudinal load member 40, environmental conditions such as temperature, humidity, and rate of use or loss of water by the cement during curing may affect the durability, longevity and load-bearing capability of the concrete. In addition, proper routing of the tendons or cables within the longitudinal load members, as discussed below, is easier to control in forming pre-cast members.

The longitudinal load member 40 includes a lower support surface 42 that engages the support structure 20 and on multiple support bridges, at least one end of the lower support surface 42 engages the upper support surface 32 of the pier 24. The longitudinal load members 40 are the primary loading carrying members extending across the gap 14 spanned by the bridge 10. The longitudinal load members 40 farther include an upper support surface 44. The upper support surface 44 primarily supports the deck slab of the bridge or wear surface or traffic surface of the road or pathway. In some embodiments, the load members 40 in particular, the upper support surface 44, may form part of the deck slab 132 or in others, just support the deck slab. As illustrated in the Figures, the I-beam only provides support to the deck slab 132 as configured in FIGS. 5 and 6, the load member 40 may form the base layer of the deck slab 132. Of course, in some embodiments, the T-beam or double T-beam may not join at the edges and only provides support similar to the support embodied by the illustrated I-beam.

The longitudinal load member 40 includes an integral tensioning system 60. The integral tensioning system 60 includes at least one internal tendon or internal longitudinal tension member 68. The internal tendon 68 may be made from a variety of materials capable of holding or maintaining the tension load applied to the tendon without failure. Steel is commonly used for internal tendons, however, for longevity, light-weightness, and tension load characteristics, it is generally preferable to use carbon-fiber reinforced polymers (CFRP), also known as carbon-fiber reinforced plastic. Any type of carbon-fiber reinforced polymer capable of supporting the desired tension load may be used as a tendon 68.

In the preferred embodiment, more than one tendon 68 is located within the longitudinal load member 40 and forms part of the integral tensioning system 60. It is preferable that the tendons 68 do not follow a straight line or exactly along the longitudinal axis 46 of the longitudinal load member 40. If more than one tendon 68 is present, at least one of the tendons may be straight and at least one tendon may not be straight. The straight tendon may follow the longitudinal axis, however, in the illustrated embodiment, the straight tendon is the lower tendon closest to the support structure 20.

In the illustrated embodiment, the longitudinal load member 40 includes three tendons and in particular, a first tendon 62 that is not straight, a second tendon 64 that is also not straight and a third tendon 66 that is straight. As illustrated, the first and second tendons 62, 64 can be approximately parallel or follow similar pathways, however, in some embodiments it may be desirable to not be approximately parallel. In general, as illustrated in the Figures, the first tendon 62 and second tendon 64 follow similar pathways while the straight tendon 66, if present, will generally follow or be approximately parallel to the longitudinal axis 46 of the load member 40. Multiple straight tendons may also be used within the load member and in particular, although not illustrated, in an I-beam three lower straight tendons could easily be used where one being centered and one on each side of the centered tendon. Of course, the number of tendons may vary depending upon the amount of load, length of span, amount of traffic and size of the beam.

The first tendon 62 generally follows a first pathway which, while illustrated as matching or approximating, does not have to match or approximate the second pathway followed by the second tendon 64. While not required, the pathways may cross longitudinal axis 46 of the longitudinal load member 40. The longitudinal internal tensioning system 60 may include a variety of connectors, anchors and other devices which are well known in the art and not described or illustrated in this application. These connectors, anchors and other devices generally allow the applying of tension to the tendons to pre-stress and to hold the tension on the tendons. Any desired type of connector, anchor or other device may be used with the tendons to provide this tension and to increase the strength and load bearing characteristics of the concrete.

The bridge 10 further includes a transverse beam 80 which includes transverse sections or members 82 between adjacent longitudinal load members 40. In some embodiments, a transverse section 82 may extend outside of the outer longitudinal load members 40. As illustrated in the Figures, the transverse tensioning system 90 having transverse tension members 92 or transverse tendons may be included to strengthen the bridge 10. The transverse tendons 92 typically pass through transverse beam and are typically substantially perpendicular to the internal longitudinal tendon 68. The transverse tendons 97 also typically pass through the longitudinal load members 40. The transverse tensioning system 90 may have any desired size, shape or configuration.

The bridge 10 further includes a longitudinal external tensioning system 70. The longitudinal external tensioning system 70 includes an external tensioning member 72 or external tendon. The external tendon 72 follows a pathway approximately similar to one of the internal tendon 68 and preferably substantially similar or even parallel. The external tendon 72 may be also formed from CFRP and the system 70 may include various anchors and other members which are not illustrated.

The transverse beams 80 include at least one of each of a first style 100 and a second style 110 of transverse beams 80. The first style or first transverse beam 100 is typically located adjacent to or in close proximity to one end of the longitudinal load members 40. Although the Figures only illustrate the first transverse beam 100 on each opposing end of the longitudinal load members 40, additional first style 100 transverse beams 80 may be used. The second style of transverse beams 110 are located inward of the first style of transverse beams 100 on a particular span 12. While the second style of transverse beams 110 may be located between the first style of transverse beams 100 on a particular span 12 which extends the length of the longitudinal load member 40, the first style of transverse beams 100 should not be located between the second style of transverse beams 110 on the same span 12.

The first style 100 of transverse beams 80 include or define a passageway 102 to which the external tendon 72 may pass and in particular the passageway 102 is on the transverse member 82. The passageway 102 is typically lined with a liner which may protect the tendon 72 and provide a low friction surface to allow easy passage of the external tendon 72 during the assembly and during tensioning of the external tendon 72. The first style 100 of transverse sections 82 may also include anchors and other devices to provide and maintain tension or the external tendon 72.

The second style of transverse beams 110 generally do not include a passageway found in the first style of transverse beams 100. However, in some embodiments, to simplify manufacturing, the second style of transverse beams may include the passageway. For the second style of transverse beams 110, instead of passing through the transverse beam 80 or member 82, instead the external tendon 72 passes around the second style 110 of transverse beams 80 and particularly around the outer, lower surface 112. Coupled to the outer, lower surface 112 may be an engagement plate 114. The engagement plate 114 may include a low friction surface or may be made from a low friction material to allow easy movement of the external tendon 72 relative to the transverse beams 80 and in particular, relative to the second style of transverse beams 110.

As illustrated in the Figures, the external tendon 72 passes through the first style 100 of transverse beams 80 to a passageway 102 and drops under the second style 110 of a particular transverse section 82. The second style 110 of the transverse member 82 would be limited to one member 82 but for most bridges expect to have more than one member between the first style 100 of transverse sections 82. The tendon 72 follows a path that extends downward and passes under each of the second style transverse members 110 and back up to pass through the passageway 102 on an opposing first style 100 of transverse members 82 on the opposing side of the span 12.

Although the external tendon 72 is illustrated in the Figures as passing in an approximately straight line under the transverse members 82 of the second style 110 of approximately the same height, in some embodiments, the tendon 72 may follow an elliptical or arcuate pathway between the two transverse members 82 of the first style 100. More specifically, the second style 110 of transverse members 82 may increase in height as they approach the center of the span such that they create an approximately arcuate pathway for the tendon to pass around when it is under tension.

If the bridge 10 includes multiple spans 12, the external tendon 72 may be limited to each span in length or more preferably, extend across the complete bridge 10. It should be noted while the internal tendon 68 may also extend the length of the bridge 10 is more preferable that they be limited to a single span 12, which is typically the length of the longitudinal load member 40 in which they are located. However, it is important to note that at least one of the internal tendons 68 on a span 12 follow a similar path to that of the external tendon 82.

With the internal and external tensioning systems in place and preferably with at least some tension applied, the road or pathway surface 136 may be applied. To form a strong surface, typically all joints 120 are filled with a filler 124 such as an epoxy. Then if desired, an FRP reinforcement layer 130 may be applied over or under a deck slab 132. The deck slab 132 may form the traffic or final surface of the bridge or an additional traffic surface may be applied to the deck slab to create the bridge 10.

The foregoing discussion discloses and describes an exemplary embodiment of the present invention. One skilled in the art will readily recognize from such discussion, and from the accompanying drawings and claims that various changes, modifications and variations can be made therein without departing from the true spirit and fair scope of the invention as defined by the following claims.

What is claimed is:

1. A bridge comprising:

a longitudinal load member having a longitudinal axis including a first longitudinal extending internal tendon extending along first predetermined path;

a continuously extending external tendon extending along a second predetermined path and wherein said first and second paths are approximately similar and wherein said continuously extending external tendon includes at least one central approximately straight portion;

a second longitudinal extending internal tendon extending along a second pathway substantially similar to said first predetermined path;

a third longitudinal extending internal tendon extending along a third pathway and wherein said third pathway is different from said first and second pathways; and at least three transverse beams each having a transverse tendon extending approximately perpendicular to said continuously extending external tendon and wherein said continuously extending external tendon passes through at least two of said transverse beams and does not pass through at least one of said transverse beams.

2. The bridge of claim 1 wherein said first path and said second paths are substantially parallel.

3. The bridge of claim 1 wherein said second longitudinal extending internal tendon is vertically aligned with said first longitudinal extending internal tendon.

4. The bridge of claim 1 further including a third longitudinal extending internal tendon, wherein said third tendon extends along an approximately straight pathway.

5. The bridge of claim 1 further including a third longitudinal extending internal tendon, wherein said third tendon extends along a pathway which is not parallel to said first and second tendons.

6. The bridge of claim 1 including a plurality of said longitudinal load members and wherein each of said at least one transverse beam includes a transverse tendon extending between said longitudinal load members.

7. The bridge of claim 1 wherein said transverse beams through which said continuously extending external tendons pass include a passageway lined with a low friction material to allow said continuously external tendons to move relative to said transverse beams.

8. The bridge of claim 1 wherein said transverse beams through which said continuously extending external tendons do not pass include a rub plate between said transverse beams and said continuously extending external tendon.

9. The bridge of claim 1 wherein said longitudinal load member has a longitudinal extent and wherein one of said transverse beams through which said continuously extending external tendon passes is located proximate to each end of the longitudinal extent of said longitudinal load member.

10. The bridge of claim 1 wherein said longitudinal load member includes a longitudinal axis and wherein said first predetermined path is not parallel to said longitudinal axis.

11. The bridge of claim 1 wherein said longitudinal load member includes a longitudinal axis and wherein said first predetermined path approximately follows said longitudinal axis with varying distance from said longitudinal axis along its longitudinal extent.

12. The bridge of claim 1 wherein said longitudinal load member includes a plurality of longitudinally extending internal tendons and wherein at least one of said longitudinally extending internal tendons crosses the transverse plane formed by said longitudinal axis.

13. The bridge of claim 1 wherein said longitudinal load member includes a longitudinal axis and a plurality of longitudinal extending internal tendons and said longitudinal extending internal tendon extending along said first predetermined path is not parallel to said longitudinal axis and wherein at least one of said plurality of longitudinal extending internal tendons is approximately parallel to and aligned with said longitudinal axis.

14. The bridge of claim 1 wherein said longitudinal load member is at least one of an T-beam, a T-beam, and a double T-beam.

15. The bridge of claim 14 wherein said longitudinal load member is a double T-beam and includes at least four internal tendons extending along pathways parallel to the pathway of said continuously extending external tendon.

16. The bridge of claim 15 wherein said longitudinal load member includes at least two internal tendons extending along pathways not parallel to the pathway of said continuously extending external tendon.

17. The bridge of claim 1 including a plurality of longitudinal load members aligned in a substantially parallel relationship and wherein said continuously extending external tendon is located between said longitudinal load members.

18. The bridge of claim 17 further including a plurality of longitudinal load members aligned with said substantially parallel load members and meet above a support structure such that each set of parallel load members creates a span of the bridge.

19. A bridge comprising:

a first and second concrete longitudinal load member each having a parallel longitudinal axis and each including a first longitudinal extending internal tendon and a second longitudinal extending internal tendon, said first longitudinal extending internal tendon extending along first predetermined path and said second longitudinal extending internal tendon extending along a second path substantially similar to said first predetermined path and wherein first and second said internal tendons are each substantially encased within said longitudinal load member;

a continuously extending external tendon extending along an external second predetermined path and adjacent to one of said first and second longitudinal load members and wherein said first and second paths are approximately similar to said external pathway and wherein said continuously extending external tendon includes a portion substantially parallel to said longitudinal load axis;

a third longitudinal extending internal tendon extending along a third pathway and wherein said third pathway is different from said first and second pathways and said external pathway; and at least one transverse tendon extending approximately perpendicular to said continuously extending external tendon.

20. The bridge of claim 19 wherein said continuously extending external tendon is not encased within one of said first and second longitudinal load members.

21. The bridge of claim 19 further including a transverse beam and wherein said external tendon passes through said transverse beam and wherein said transverse tendon is located within said transverse beam.

22. The bridge of claim 21 wherein said transverse beam is formed of multiple segments, each segment being adjacent to one of said first and second longitudinal load members.

23. The bridge of claim 21 wherein further including a second transverse beam and wherein said external tendon does not pass through said second transverse beam.

* * * * *